US009702129B2

(12) United States Patent
Homami et al.

(10) Patent No.: US 9,702,129 B2
(45) Date of Patent: Jul. 11, 2017

(54) ADJUSTABLE OVERFLOW CLOSURE DEVICE

(71) Applicants: Max Homami, Los Angeles, CA (US); Michael Gerard Rohlfs, Los Angeles, CA (US)

(72) Inventors: Max Homami, Los Angeles, CA (US); Michael Gerard Rohlfs, Los Angeles, CA (US)

( * ) Notice: Subject to any disclaimer, the term of this patent is extended or adjusted under 35 U.S.C. 154(b) by 0 days.

(21) Appl. No.: 15/217,941

(22) Filed: Jul. 22, 2016

(65) Prior Publication Data

US 2016/0333557 A1 Nov. 17, 2016

Related U.S. Application Data

(63) Continuation-in-part of application No. 14/626,930, filed on Feb. 20, 2015, and a continuation-in-part of application No. 14/137,958, filed on Dec. 20, 2013, now Pat. No. 9,157,222, which is a continuation of application No. 13/563,666, filed on Jul. 31, 2012, now Pat. No. 8,635,719.

(60) Provisional application No. 62/196,412, filed on Jul. 24, 2015, provisional application No. 61/942,607, filed on Feb. 20, 2014, provisional application No. 61/514,340, filed on Aug. 2, 2011.

(51) Int. Cl.
*E03C 1/244* (2006.01)
*E03C 1/24* (2006.01)

(52) U.S. Cl.
CPC ..... *E03C 1/244* (2013.01); *E03C 2001/2406* (2013.01); *Y10T 137/86863* (2015.04)

(58) Field of Classification Search
CPC .... E03C 1/232; E03C 1/24; E03C 2001/2413; E03C 1/244
USPC ..... 4/694, 668, 685, 674, 679, 690, 255.01
See application file for complete search history.

(56) References Cited

U.S. PATENT DOCUMENTS

| | | | | |
|---|---|---|---|---|
| 1,281,222 | A | 10/1918 | Stepanchak | |
| 3,559,634 | A | 2/1971 | Lillywhite | |
| 3,570,020 | A * | 3/1971 | Kato | E03C 1/24 4/694 |
| 3,835,484 | A * | 9/1974 | Kato | E03C 1/232 251/351 |
| 3,927,428 | A | 12/1975 | Jette et al. | |
| 4,042,984 | A | 8/1977 | Butler | |
| 4,524,798 | A | 6/1985 | Simard | |
| 4,607,658 | A | 8/1986 | Fraser et al. | |
| 4,744,108 | A | 5/1988 | Schmidt | |

(Continued)

*Primary Examiner* — Christine Skubinna
(74) *Attorney, Agent, or Firm* — Hackler Daghighian Martino & Novak

(57) ABSTRACT

An overflow for a tub or basin includes a bracket and a movable cover. A water passageway is disposed through the bracket. The cover is attached to the bracket and translatably movable by a user. A drain aperture is disposed through the cover. An edge is disposed along a perimeter of the cover with a channel disposed on an inside edge surface. The bracket includes a flexure or a pin biased by a spring. When the cover is attached to the bracket the flexure or pin is partially disposed within the channel creating a force biasing the cover to remain attached to the bracket. Alternatively, a magnet may be used to bias the cover to the bracket. When the cover is in an open position, water can flow through both the bracket and the cover. When the cover is in a closed position, it blocks the flow of water.

12 Claims, 20 Drawing Sheets

(56) References Cited

U.S. PATENT DOCUMENTS

| | | | | |
|---|---|---|---|---|
| 5,123,123 | A | 6/1992 | Hart et al. | |
| 5,190,077 | A | 3/1993 | Pawelzik et al. | |
| 6,216,288 | B1 | 4/2001 | Bernau | |
| 6,732,388 | B2 | 5/2004 | McKenna | |
| 6,895,610 | B2 | 5/2005 | Olson | |
| 7,451,502 | B2 | 11/2008 | Ball | |
| 8,112,832 | B2 * | 2/2012 | Hecker | E03C 1/0401 4/675 |

* cited by examiner

OVERFLOW OPEN
CABLE DRAIN CLOSED

OVERFLOW CLOSED
CABLE DRAIN OPEN

ADJUSTABLE OVERFLOW CLOSURE DEVICE

CROSS-REFERENCE TO RELATED APPLICATIONS

This continuation-in-part application claims priority to provisional application 62/196,412 filed on Jul. 24, 2015. This continuation-in-part application also claims priority to continuation-in-part application Ser. No. 14/626,930 filed on Feb. 20, 2015, which itself claimed priority to provisional application 61/942,607 filed on Feb. 20, 2014. Continuation-in-part application Ser. No. 14/626,930 claimed priority to continuation application Ser. No. 14/137,958 filed on Dec. 20, 2013. Continuation application Ser. No. 14/137,958 claimed priority non-provisional application Ser. No. 13/563,666 filed on Jul. 31, 2012, now U.S. Pat. No. 8,635,719 which also claimed priority to provisional application 61/514,340 filed on Aug. 2, 2011. The contents of all applications reference above are fully incorporated herein with these references.

DESCRIPTION

Field of the Invention

The present invention generally relates to overflow closure devices and overflow drains. More particularly, the present invention relates to a closeable overflow drain in a rectangular and/or linear shape.

Background of the Invention

A typical bathtub has a lower drain at the lowest part of the tub and an upper overflow drain mounted on a side wall near the front of the tub. The lower drain is typically used to control the amount of water located within the tub. When the lower drain is open, water can quickly exit out the lower drain. The overflow drain facilitates the water quickly leaving through the lower drain by allowing air to vent through.

When the lower drain is closed, water fills within the tub. If one was to leave the water on, the water would fill the tub and overflow the tub. To prevent this, the typical overflow drain has an opening which allows water to escape through the drainage/plumbing.

The typical overflow device is generally circular and has a water opening located at its lower most portion. A problem arises when a person wants to use the tub and allow water to fill within. It is very common for the overflow drain to prevent the water level rising to a sufficient level to make the bathing experience enjoyable. The overflow drain decreases the height of water available in the bath tub or sink. As many common tubs are as little as fourteen inches high, the amount of usable water in the tub can be as little as seven inches due to the overflow drain.

Others have attempted to solve this problem by creating plugs that can be inserted into existing overflow drains. These plugs are cumbersome, are easily lost or fall out from within the overflow drain making loud noises and risk being stepped on by the user. Also, they prevent air from escaping through the overflow device when draining a tub or sink.

Others have attempted to create cumbersome and complicated devices that allow one to control the level of water with floats, automatic switches and electronics. However, these devices are not easily incorporated into existing tub designs and are impractical for normal usage.

Others have attempted to attach snorkels to the overflow drains. The snorkels may be positioned to control the height of the water within the tub. However, these snorkels are odd in appearance and detract from the aesthetics of the tub's appearance. Also, the snorkels cannot completely seal the overflow drain completely allowing water to rise well above the snorkel.

Accordingly, there is a need for a novel adjustable overflow closure device that allows one to vary the height of the water level and even to seal the overflow completely while remaining aesthetically pleasing and functionally easy to use. The present invention fulfills these needs and provides other related advantages.

SUMMARY OF THE INVENTION

An exemplary embodiment of the present invention is a closeable overflow for a tub or a basin. A bracket is attachable to an inside vertical surface of the tub or the basin. The bracket defines a flat front bracket surface opposite a flat back bracket surface. The flat back bracket surface is configured to abut the inside vertical surface of the tub or the basin with the flat front bracket surface facing outwardly into the tub or the basin. At least one fixture aperture is disposed through the bracket extending to and between the flat front and back bracket surfaces. At least one water passageway is disposed through the bracket extending to and between the flat front and back bracket surfaces. A cover is attachable to the bracket and translatably movable by a user along a plane of the flat front bracket surface. The cover defines a flat front cover surface opposite a flat back cover surface. At least one drain aperture is disposed through the cover extending to and between the flat front and back cover surfaces. The cover moved by the user to an open position has at least a portion of the at least one drain aperture of the cover overlapping at least a portion of the at least one water passageway of the bracket. The cover moved by the user to a closed position does not have at least a portion of the at least one drain aperture of the cover overlapping at least a portion of the at least one water passageway of the bracket.

In other exemplary embodiments, the cover may include an edge disposed along a perimeter of the cover. The edge may be disposed in a direction away from the flat front cover surface extending beyond the flat back cover surface. The edge may define an outside edge surface opposite an inside edge surface.

A channel may be disposed on at least a portion of the inside edge surface.

The bracket may be include at least one flexure, wherein when the cover is attached to the bracket the at least one flexure is partially disposed within the channel creating a force biasing the cover to remain attached to the bracket.

A first seal may be disposed between the flat front bracket surface and the flat back cover surface, wherein the first seal is a gasket or an o-ring.

The at least one fixture aperture may comprises a counterbore or a countersink, the counterbore or the countersink fully encasing a head of a fastener where a top of the head of the fastener is at or below the flat front bracket surface. A threaded portion of the fastener may extend through the at least one fixture aperture and protrude past the flat back bracket surface.

The cover may be rectangular shaped.

A second seal may be attached to the flat back bracket surface.

The at least one fixture aperture may comprise two apertures disposed on either sides of the at least one water passageway.

The bracket may include at least one pin biased by a spring, wherein when the cover is attached to the bracket the at least one spring pin by the spring is partially disposed within the channel creating a force biasing the cover to remain attached to the bracket.

The bracket may include a magnet and at least a portion of the cover is ferromagnetic, the magnet configured to pull the cover towards the bracket.

The bracket may include a secondary water passageway connecting a top of the bracket to the at least one water passageway.

The bracket may include a secondary water passageway connecting the flat front bracket surface or an edge surface of the bracket to the at least one water passageway, the secondary water passageway including a pivotable and at least partially ferromagnetic valve held in a closed position by an adjustably positionable magnet.

A movable bottom drain knob may be disposed on the flat front cover surface, the movable bottom drain knob attached to a cable, the cable configured to control a closing and opening of a bottom drain, the bottom drain having a drain plug sealable to a drain flange.

The drain plug may comprise a pressure dependent water passageway extending from a top of the drain plug to a bottom of the drain plug, the pressure dependent water passageway including a pivotable and at least partially ferromagnetic valve held in a closed position by an adjustably positionable magnet, wherein the valve disposed in the closed position is generally horizontal and the location of the pivot is offset about a center of the valve separating a lighter portion of the valve from a heavier portion of the valve, wherein the magnet is disposed above the lighter portion of the valve, wherein the heavier portion of the valve does not block a flow of water through the pressure dependent water passageway and the lighter portion of the valve does block the flow of water through the pressure dependent water passageway when in in the closed position.

An exemplary embodiment of the present invention is an electronic control system for a tub or a basin without an overflow drain. The system includes a key pad having a drain button and a resume fill button. A control box is in electrical communication with the key pad. A motorized and electronically controlled bottom drain assembly is in electrical communication with the control box. A first sensor is configured to be disposed near or at the top of the tub or the basin, the first sensor in electrical communication with the control box. A second sensor is configured to be disposed below the first sensor, the second sensor in electrical communication with the control box. The drain button controls an opening and closing of the bottom drain assembly. A motorized and electrically controlled flow valve is located at, within or before a faucet associated with the tub or the basin, the flow valve in electrical communication with the control box. The control box sends a first signal to the flow valve to stop a flow of water when a water level reaches the second sensor. The user can activate the resume fill button which causes the control box to open the flow valve to resume the flow of water. The control box sends a second signal to the bottom drain assembly to open when the water level reaches the first sensor and sends a third signal to the flow valve to stop a flow of water.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

For congruity, it is noted herein that the numerals disclosed and used herein in the present application are intended to be consistent with the previous applications incorporated by reference. Similarly, provisional application 62/196,412 filed on Jul. 24, 2015 is incorporated herein in its entirety and therefore has not been repeated for brevity.

Figure 1:
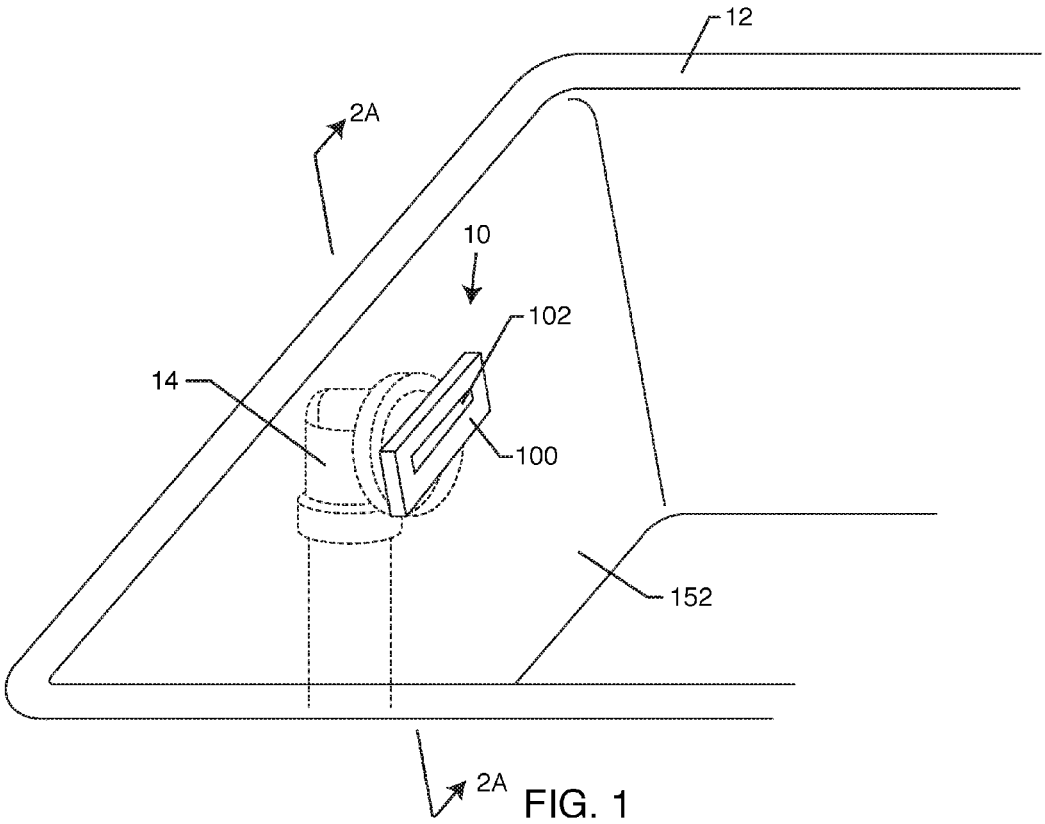
FIG. 1 PRIOR ART
FIG. 1 is a perspective view of a prior art overflow drain.

FIG. 1 is a perspective view of an exemplary adjustable overflow closure device 10. FIG. 1 of the present invention is very similar to FIG. 1 of U.S. Pat. No. 8,635,719 where the overflow drain 10 was mounted to an inside surface of a tub 12 and the overflow elbow 14 was shown in dashed lines on the outside surface of the tub 12. In contrast to FIG. 1 of the '719 patent, here the overflow closure device 10 takes on a rectangular-shaped faceplate 100 with a horizontal slot 102. The industry has moved towards a very sleek and simplistic design for the various faucets and drains. Here, a rectangular-shaped faceplate 100 provides an aesthetically pleasing shape and design. The faceplate 100 and bracket 112 are longer in dimension 144 in a horizontal direction as compared to a dimension 146 in a vertical direction.

Figure 2:
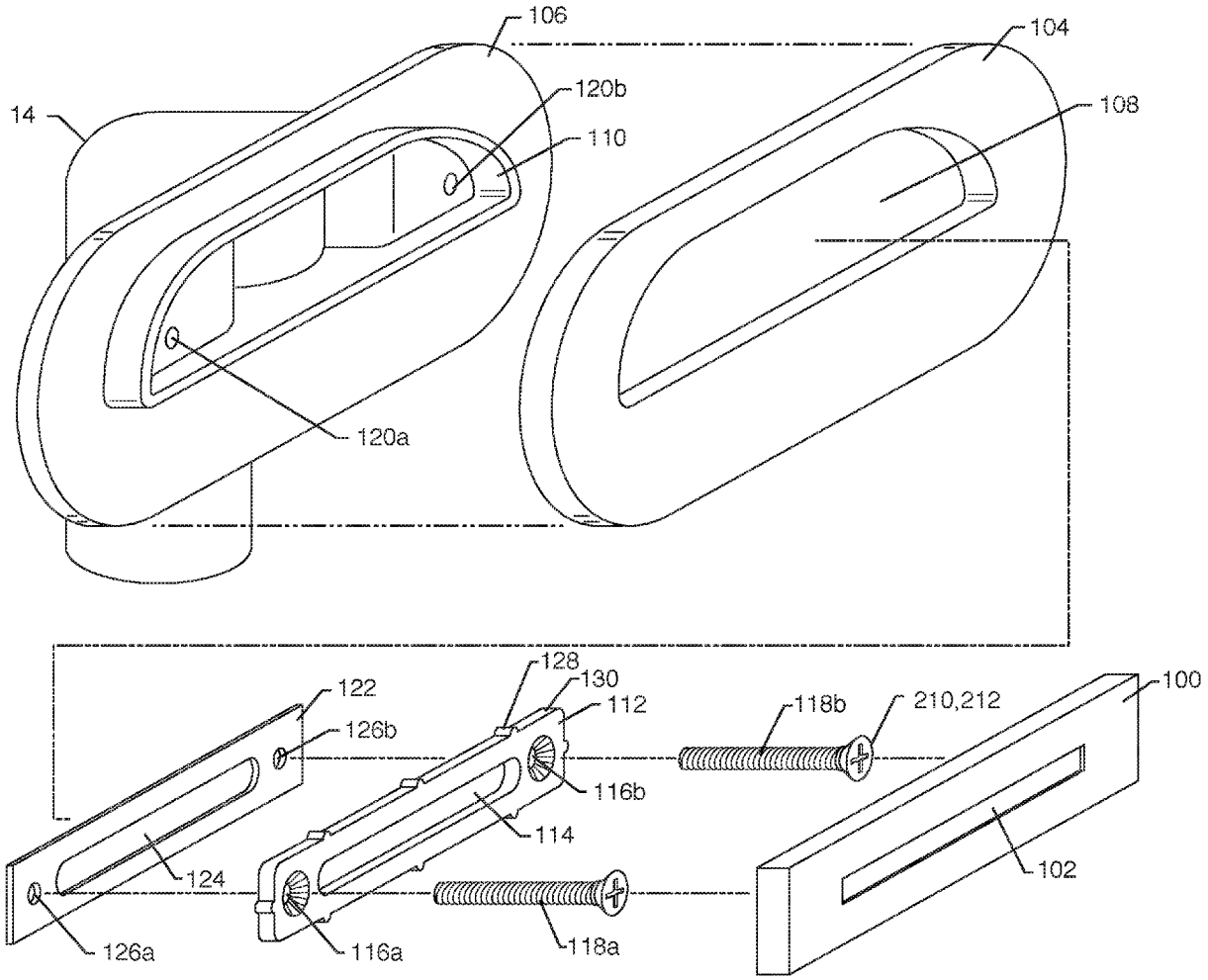
FIG. 2 is an exploded perspective view of a prior art overflow drain assembly.

FIG. 2 is an exploded perspective view of the structure 10 shown in FIG. 1. The overflow elbow 14 has a seal/gasket 104 that is used to create a watertight seal between the overflow elbow 14 and the outside surface 150 of the tub 12. The overflow elbow 14 has a flange 106 that extends outward along the surface of the wall of the tub 12. The large flange 106 helps to create a large surface area to mate up against the outside of the tub 12. The seal/gasket 104 has an aperture 108 and fits onto a perimeter riser 110 of the elbow 14. In this way the seal 104 nests onto the elbow in a secure manner.

On the inside surface 152 of the tub 12 is installed a bracket 112. The bracket 112 has as a slot opening 114 and two countersunk holes 116*a* and 116*b*. Screws 118*a* and 118*b* are designed to nest within the bracket 112 such that the heads of the screws are at or below the top surface of the bracket 112. The screws 118 are then able to pass through the bracket, pass through holes drilled into the tub 12 and engage into holes 120*a* and 120*b* of the elbow 14.

Another seal/gasket 122 is formed that matches the backside of the bracket 112. The seal 122 also has a slot 124 and matching holes 126*a* and 126*b*. The seal 122 could be a separate part or could be made with adhesive backing. For instance the seal 122 could be preinstalled onto the gasket 112. Then the installer would simply have to peel off a backing layer and then push the bracket 112 and seal 122 onto the appropriate location.

One will notice that the bracket 112 has a plurality of compressible nubs 128 disposed about the perimeter 130 of the bracket 112. When the faceplate 100 is pressed onto the bracket 112, the nubs compress a slight amount and hold the faceplate 100 in place.

Figure 2A:
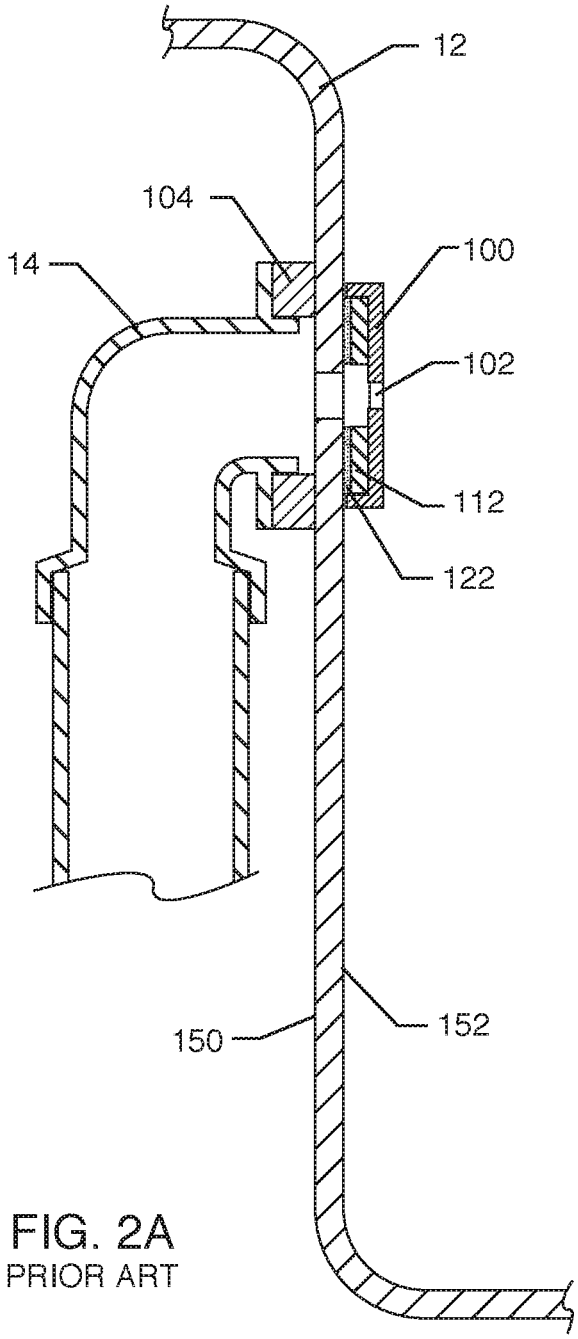
FIG. 2A PRIOR ART
FIG. 2A is a sectional view through a center of the overflow drain assembly of FIG. 2 taken along lines 2A and 2A.

FIG. 2A is a cross-sectional view taken along the lines 2A-2A from the structure of FIG. 1. Here, one can see that the faceplate 100 is shaped to overlap the bracket 112 such that the faceplate 100 is the only part visible once the installation is complete. This facilitates a simple and sleek appearance to the end user.

A problem with the prior art is that the overflow closure device 10 may be installed too low within the tub 12. This means one cannot fill the tub to a desired level such that the bathing experience is enjoyable. Therefore, a need exists to find a solution to this problem in the form and shape of the prior art that has increased functionality but retains the new and sleek look.

An exemplary embodiment of the present invention is a closeable overflow 200 for a tub or a basin 12. A bracket 112 is attachable to an inside vertical surface 152 of the tub 12 or the basin 12. The bracket 112 can be made from plastic, metals, composites or variations thereof. The bracket 12 defines a flat front bracket surface 202 opposite a flat back bracket surface 204. The flat back bracket surface 204 is configured to abut the inside vertical surface 152 of the tub 12 or the basin 12 with the flat front bracket surface 202 facing outwardly into the tub 12 or the basin 12.

Figure 6:
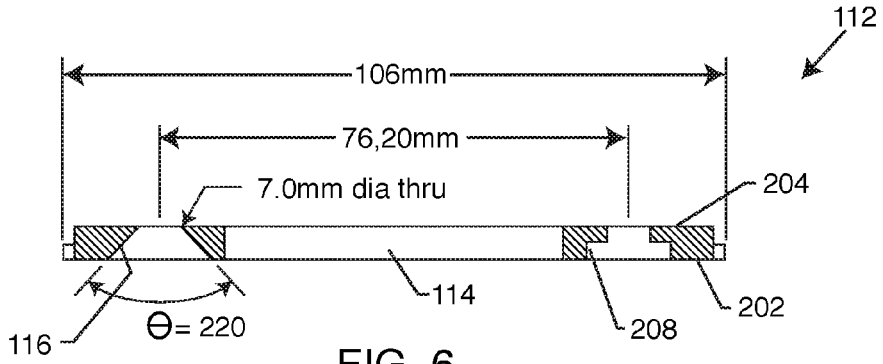
FIG. 6 is a sectional view taken along lines 6-6 from FIG. 5.

At least one fixture aperture 206 is disposed through the bracket 112 extending to and between the flat front 202 and back bracket surfaces 204. The at least one fixture aperture may comprises a counterbore 208 or a countersink 116. The counterbore or the countersink are designed to fully encase a head 210 of a fastener 118 where a top 212 of the head 210 of the fastener 118 is at or below the flat front bracket surface 202. A threaded portion of the fastener 118 may extend through the at least one fixture aperture 206 and protrude past the flat back bracket surface 204. The countersink 116 is best seen in FIG. 6 and shows angle 220.

At least one water passageway 114 is disposed through the bracket 112 extending to and between the flat front 202 and back bracket surfaces 204. A cover (i.e. faceplate) 100 is attachable to the bracket 112 and translatably movable by a user along a plane 214 of the flat front bracket surface 202. The cover 100 defines a flat front cover surface 216 opposite a flat back cover surface 218. At least one drain aperture (i.e. slot) 102 is disposed through the cover 100 extending to and between the flat front 216 and back cover surfaces. The cover 100 can be moved by the user to an open position has at least a portion of the at least one drain aperture 102 of the cover 100 overlapping at least a portion of the at least one water passageway 114 of the bracket 112. The cover 100 can also be moved by the user to a closed position that does not have at least a portion of the at least one drain aperture 102 of the cover 100 overlapping at least a portion of the at least one water passageway 114 of the bracket 112.

Figure 7:
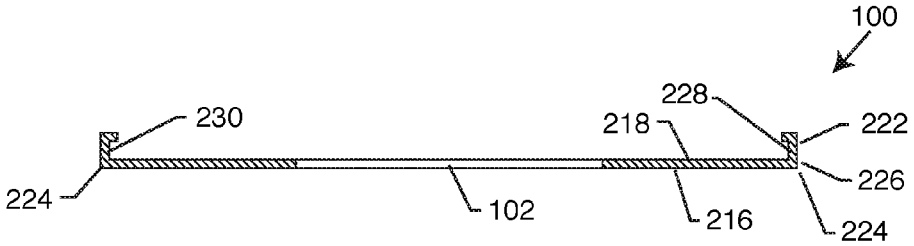
FIG. 7 is a sectional view taken through a centerline of an exemplary cover of the structure of FIG. 3 along lines 7-7.

As best seen in FIG. 7, the cover 100 may include an edge 222 disposed along a perimeter 224 of the cover 100. The edge 222 may be disposed in a direction away from the flat front cover surface 216 extending beyond the flat back cover surface 218. The edge 222 may define an outside edge surface 226 opposite an inside edge surface 228. A channel 230 may be disposed on at least a portion of the inside edge surface 228.

Figure 4:
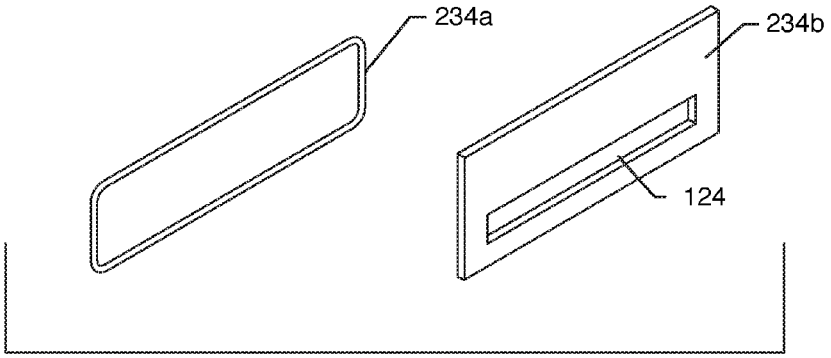
FIG. 4 is a perspective view of a seal for the structure of FIG. 3.
Figure 5:
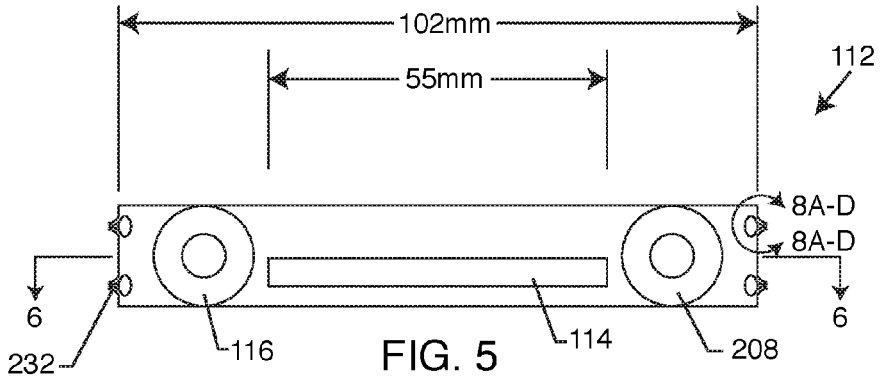
FIG. 5 is a front view of an exemplary bracket of the structure of FIG. 3.

As shown in FIG. 4, a first seal 234 may be disposed between the flat front bracket surface 202 and the flat back cover surface 218. The first seal 234 may a gasket 234*b* or an o-ring 234*a*. As shown in FIG. 2, a second seal 122 may be attached to the flat back bracket surface 204.

Figure 8A:
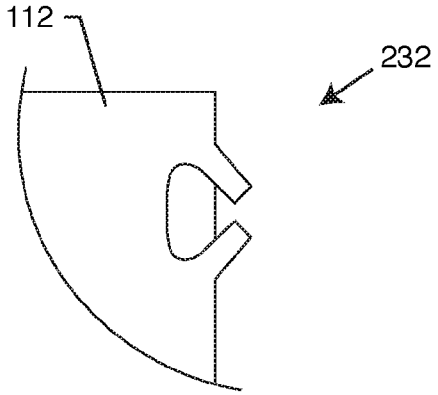
FIG. 8A is an enlarged front view of a flexure taken along lines 8A-8A from FIG. 5.
Figure 8B:
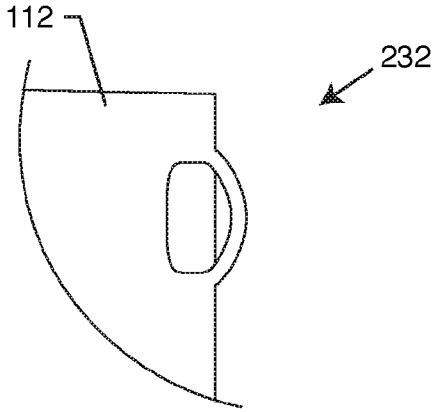
FIG. 8B is an enlarged front view of a flexure taken along lines 8B-8B from FIG. 5.
Figure 8C:
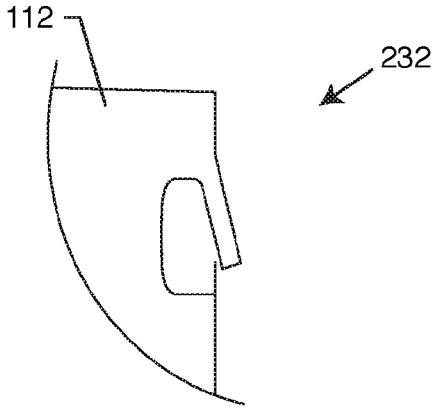
FIG. 8C is an enlarged front view of a flexure taken along lines 8C-8C from FIG. 5.

As best seen in FIGS. 5, 6 and 8A-C, the bracket 112 may be include at least one flexure 232. When the cover 100 is attached to the bracket 112, the at least one flexure 232 is partially disposed within the channel 230 creating a force biasing the cover 100 to remain attached to the bracket 112. FIGS. 8A-8C show various embodiments of how the flexure 232 can be created. FIG. 8A shows a double flexure design that is split in the middle. FIG. 8B, shows a single flexure similar to FIG. 8A, but here the split is removed and the flexure is one continuous part. FIG. 8C is a split flexure design but utilizes only one protrusion. When the bracket 112 is made from a resilient material, the flexures can be bent and/or compressed and then exert an opposite force. Also, it is noted that the flexure 232 does not extend all the way through the entire thickness of the bracket 112. This is because the flexure 232 is captured by the channel 230.

Figure 8D:
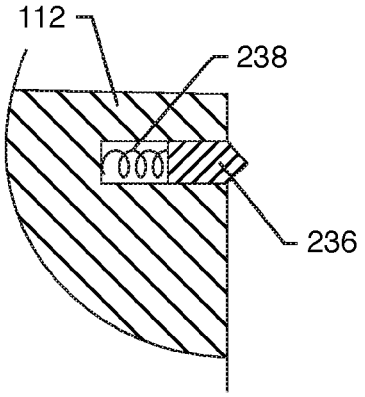
FIG. 8D is an enlarged sectional view similar to those taken along lines 8D-8D from FIG. 5, but now showing a new embodiment of a pin and a spring.

An alternative to using flexures is shown in FIG. 8D, which is a sectional view to show the inner workings. The bracket 112 may include at least one pin 236 biased by a spring 238. When the cover 100 is attached to the bracket 112 the at least one pin 236 biased by the spring 238 is partially disposed within the channel 130 creating a force biasing the cover to remain attached to the bracket. As can be seen and understood, a multitude of pin/springs can be used, as also a multitude of flexures 232 can be used. As shown herein, each side would have 2 flexures or 2 sets of pin/springs.

Figure 3:
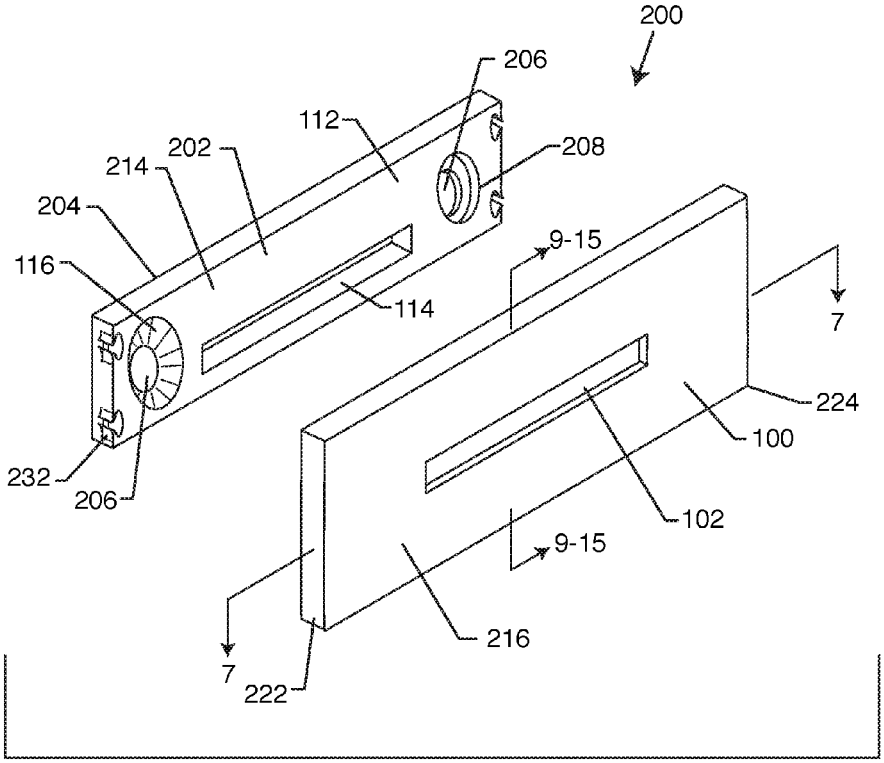
FIG. 3 is a perspective view of an exemplary closeable overflow of the present invention.
Figure 9:
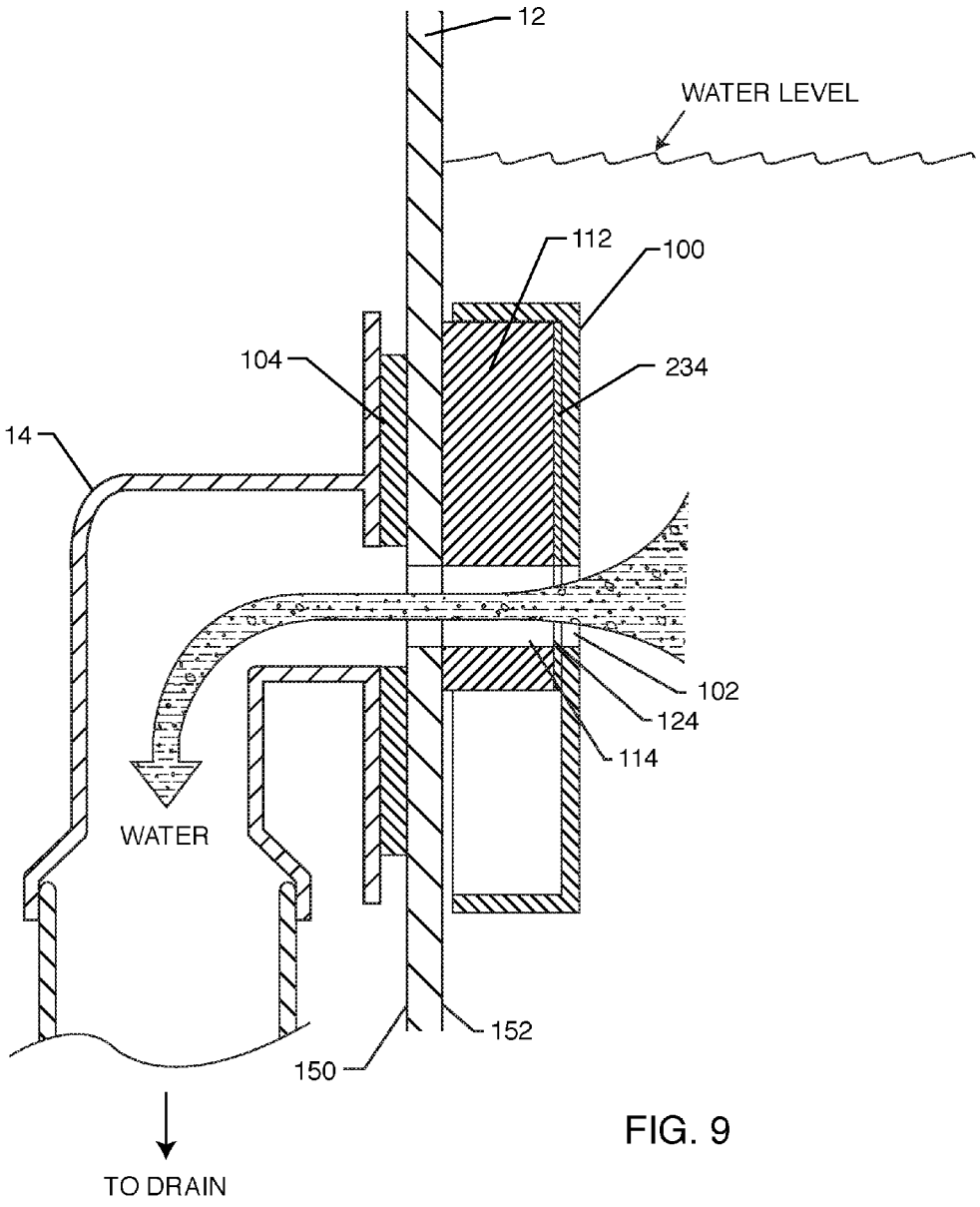
FIG. 9 is a sectional view through a center of an exemplary closeable overflow when installed onto a tub, where the overflow is in the open position.

FIG. 9 is a sectional view taken along lines 9-9 from FIG. 3 in a general sense, but now shows how the structure of FIG. 3 would be attached in practice to an actual tub 12. FIG. 9 shows how the drain aperture 102 lines up with the slot 124 in the gasket which also lines up with the water passageway 114. This is the open position, where water can flow from the tub through to the overflow elbow 14.

Figure 10:
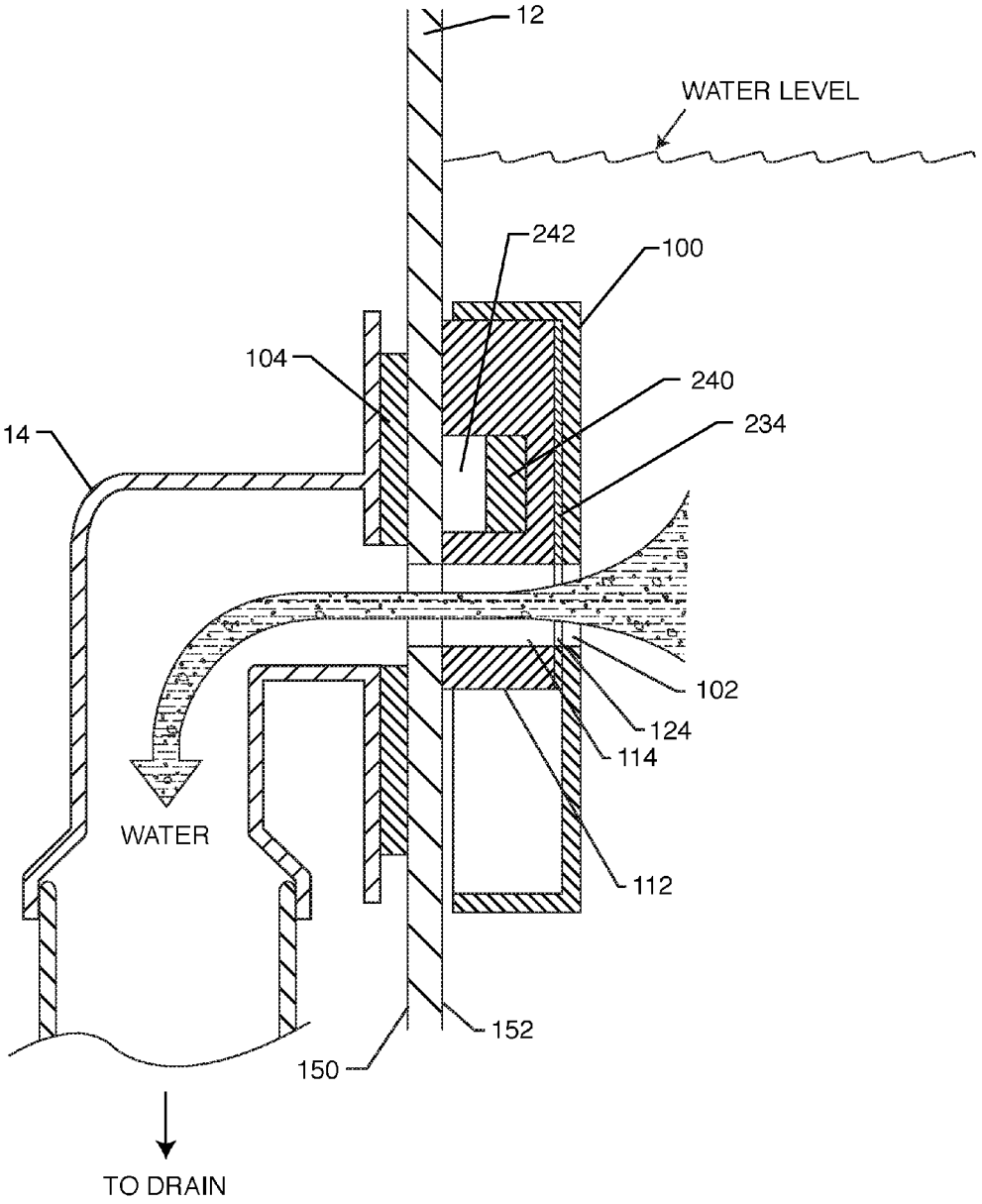
FIG. 10 is a sectional view similar to FIG. 9, but now shows a new embodiment that utilizes a magnet to bias the cover against the seal and/or bracket.

FIG. 10 is a variation from FIG. 9. Rather than using flexures or pins, a magnet 240 is attached to the bracket 112. The magnet can be attached from either side of the bracket, but here is shown disposed within a blind hole 242. This embodiment keeps the magnet 240 away from coming into contact with the water inside the tub. The cover 100 would then be made from a ferromagnetic material such that it would be attracted to the magnet 240. In this way a force is generated that keeps the cover biased against the bracket 112, or the biased against the seal 234 which is attached to the bracket 112.

Figure 11:
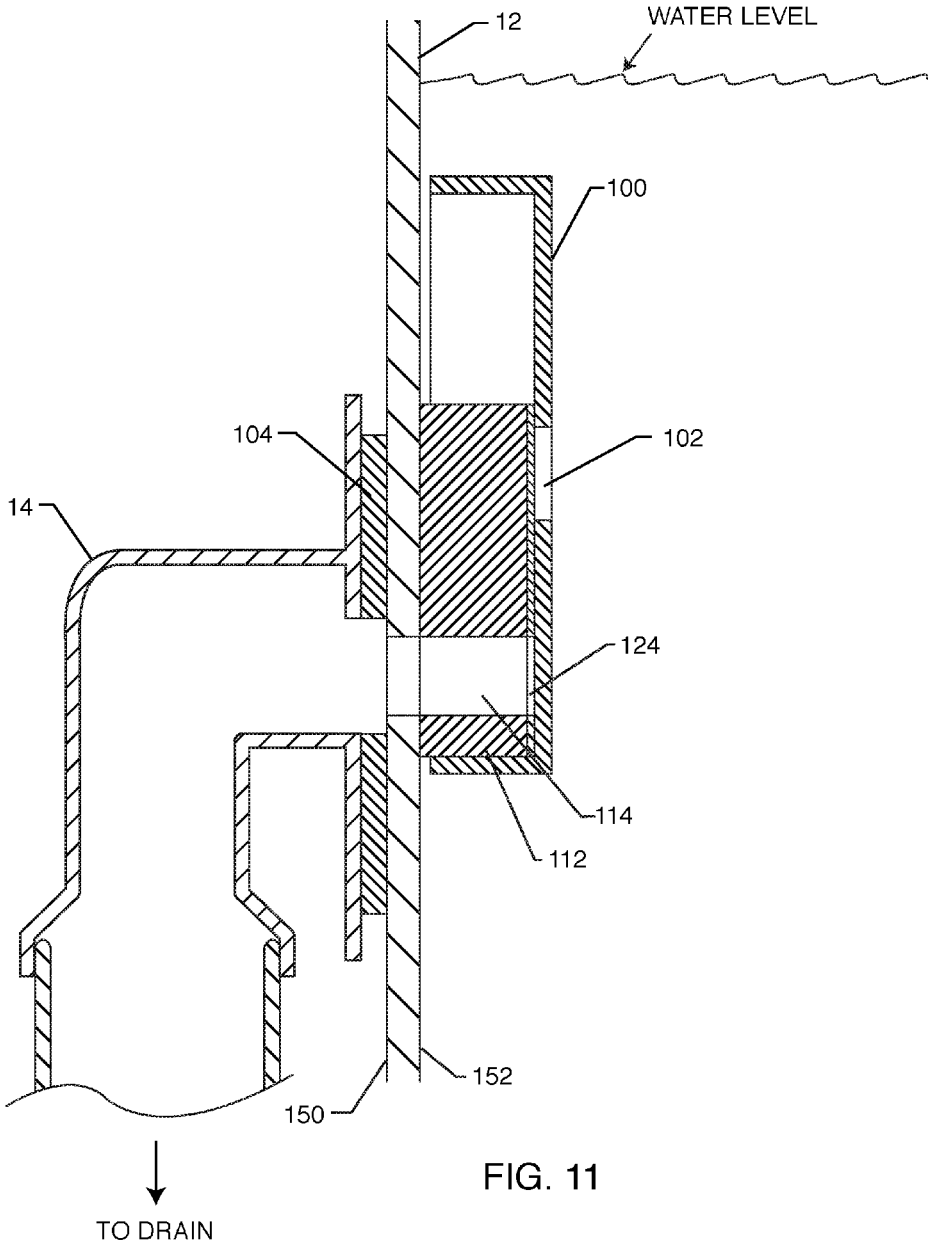
FIG. 11 is a sectional view of the structure of FIG. 9, now showing the cover moved upwards into a closed position that closes the flow of water through the overflow.

FIG. 11 is similar to FIG. 9, just now the cover 100 has been moved into the closed position by the user, where now no part of the water passageway 114 overlaps the drain aperture 102. The user would simply grasp the cover 100 with their hand and slide the cover 100 upwards (or downwards if the design was flipped).

Figure 12:
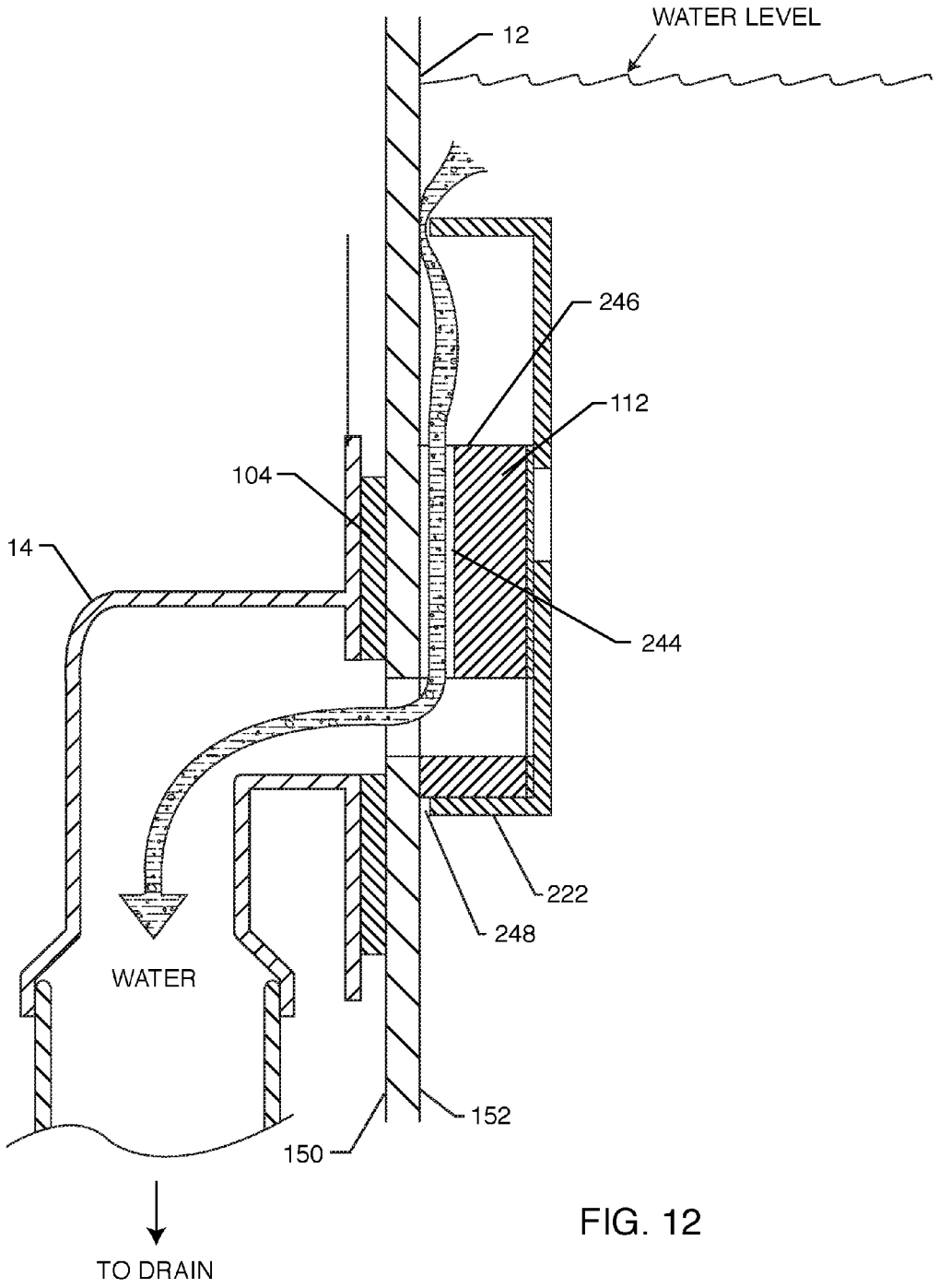
FIG. 12 is a sectional view similar to that of FIG. 11, but now shows a new embodiment of the bracket with a second water passageway at the top that is a safety feature to prevent overflow conditions.

The embodiments of FIGS. 9-11 may violate certain building codes or still be undesirable as they present an overflow hazard. To alleviate these concerns, the embodiment shown in FIG. 12 includes a secondary water passageway 244 in the bracket 112 connecting a top 246 of the bracket to the at least one water passageway 244. Water is still able to flow between the gap 248 between the edge 222 of the cover 100 and the inside surface 152 of the tub 12.

Figure 13:
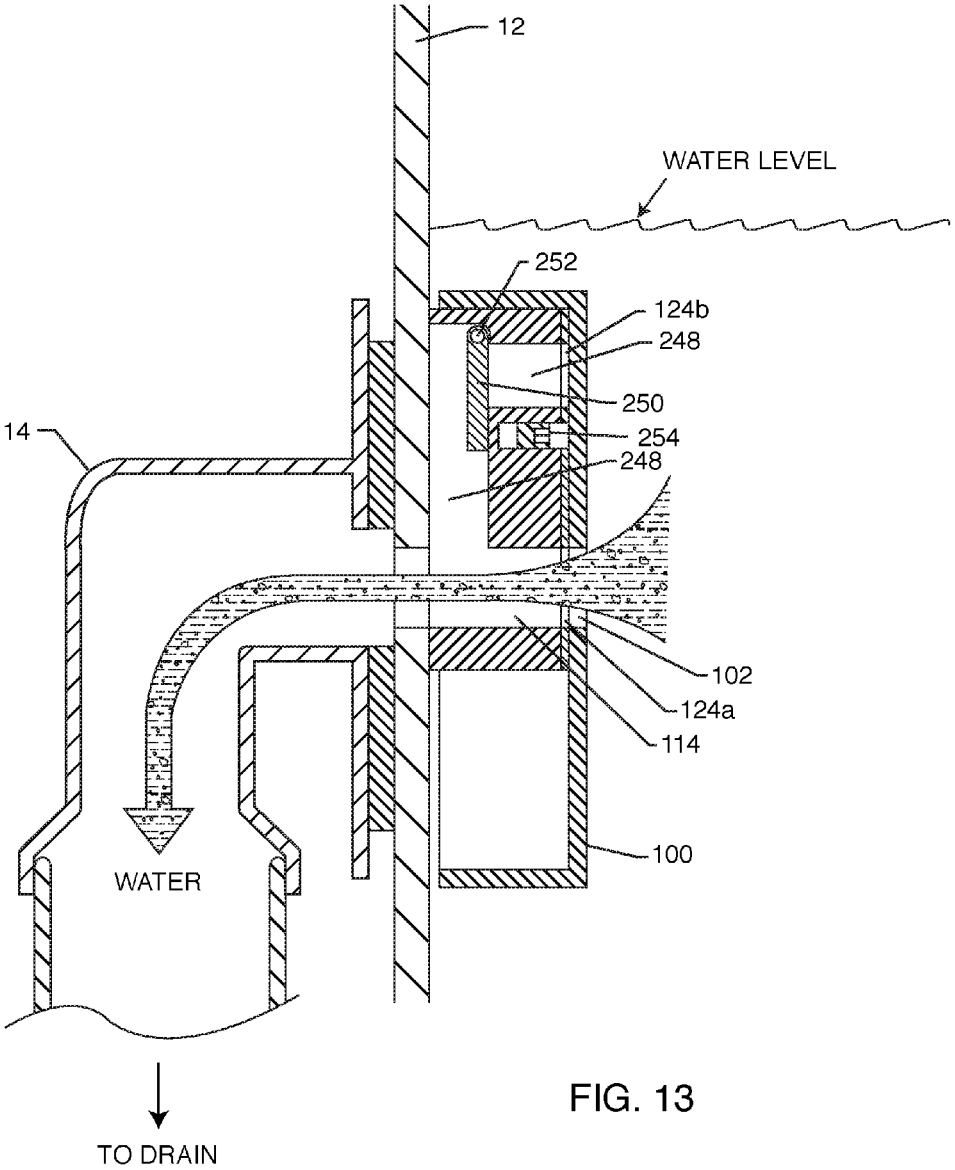
FIG. 13 is a sectional view similar to that of FIG. 9, but now shows a new embodiment of an overflow with an overflow valve, where the overflow valve is not in being engaged because the main water passageway is already open.

As shown in FIG. 13, the bracket 112 may include another secondary water passageway 248 connecting the flat front bracket surface 202 or an edge surface 246 of the bracket 112 to the water passageway 114. As can be understood by those skilled in the art, the opening from the bracket 112 to the secondary water passageway 114 can come from any exposed surface of the bracket 112 and does not have to come from the top as shown in FIG. 13.

A pivotable and at least partially ferromagnetic valve 250 is held in a closed position by an adjustably positionable magnet 254. The valve 250 rotates about pivot 252. The magnet 254 attracts the valve 250 and biases it in the closed position. The magnet 254 as shown here is in the form of a set screw, such that it can be screwed closer to or further away from the valve 250. When the cover 100 is in the open position water flows through the drain aperture 102 as previously shown.

Figure 14:
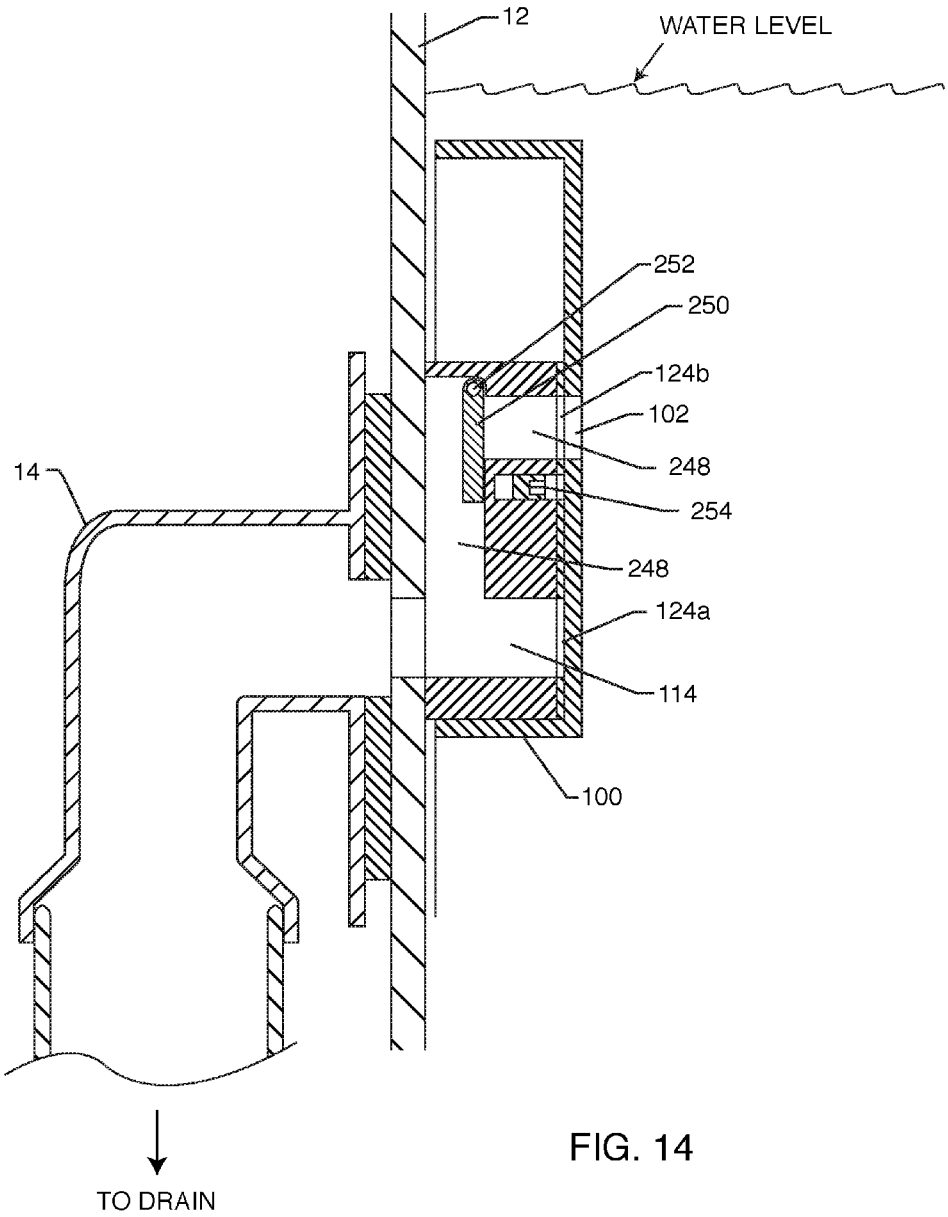
FIG. 14 is a sectional view of the structure of FIG. 13, where now the cover has been moved into the closed position and the valve is being engaged but not opening due to the lack of water pressure.

FIG. 14 is the same structure as FIG. 13, but now shows the cover 100 moved upwards into the closed position. The valve 248 is still in a closed position as the magnet 254 biases the valve shut. The water above the valve 250 does create a pressure pressing against the valve 250, yet the strength of the magnet is stronger.

Figure 15:
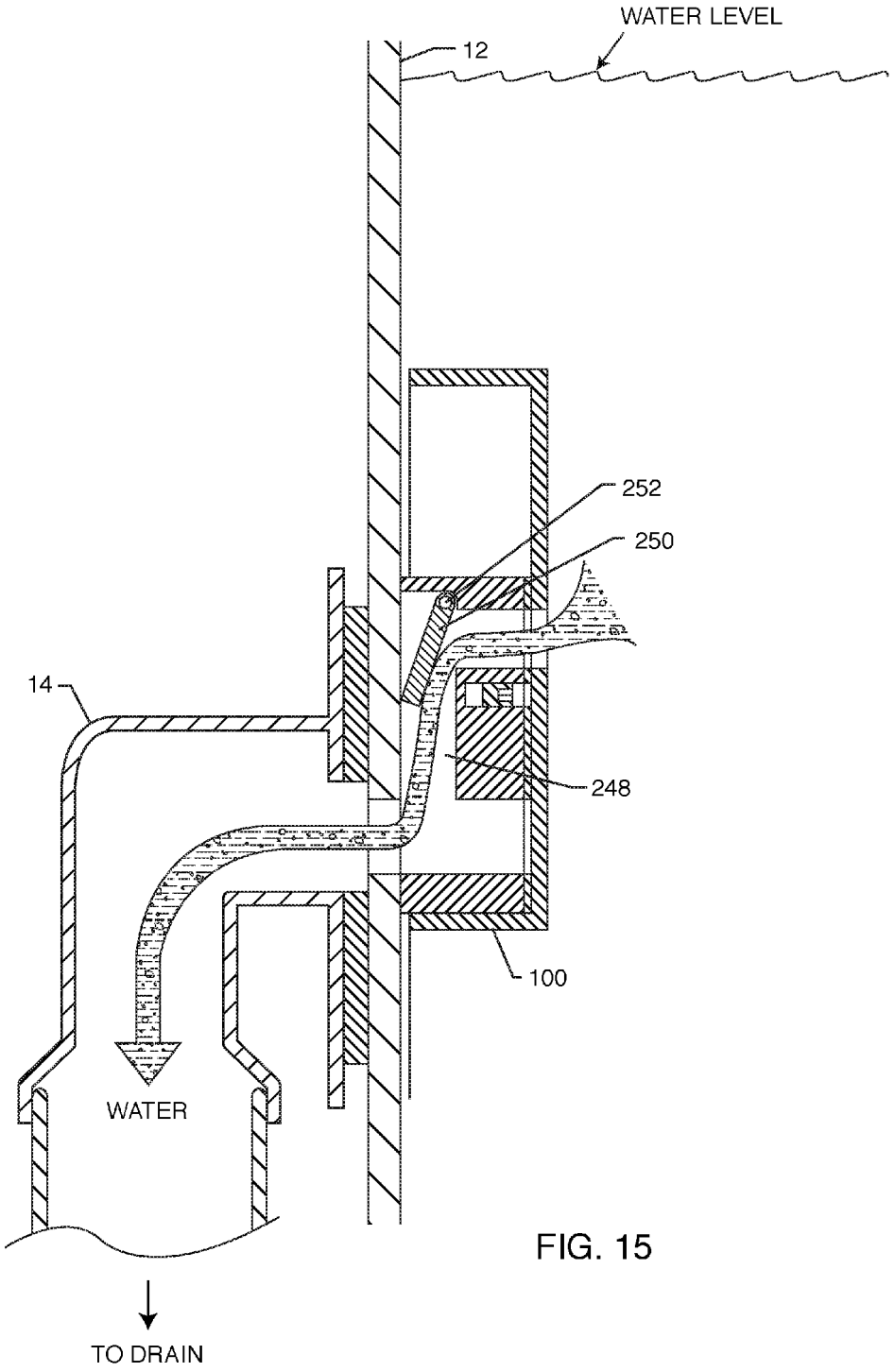
FIG. 15 is a sectional view of the structure of FIG. 14, where now the water level has risen and created enough pressure to open the valve thereby releasing water through its secondary water passageway and into the overflow elbow.

FIG. 15 is the same structure as FIG. 14, yet now the water level is substantially higher. At this point, the water pressure is too much for the magnet 254 to handle and the water pressure forces the valve 250 to open. Water can then drain through the second water passageway and into the overflow elbow 14.

Figure 16:
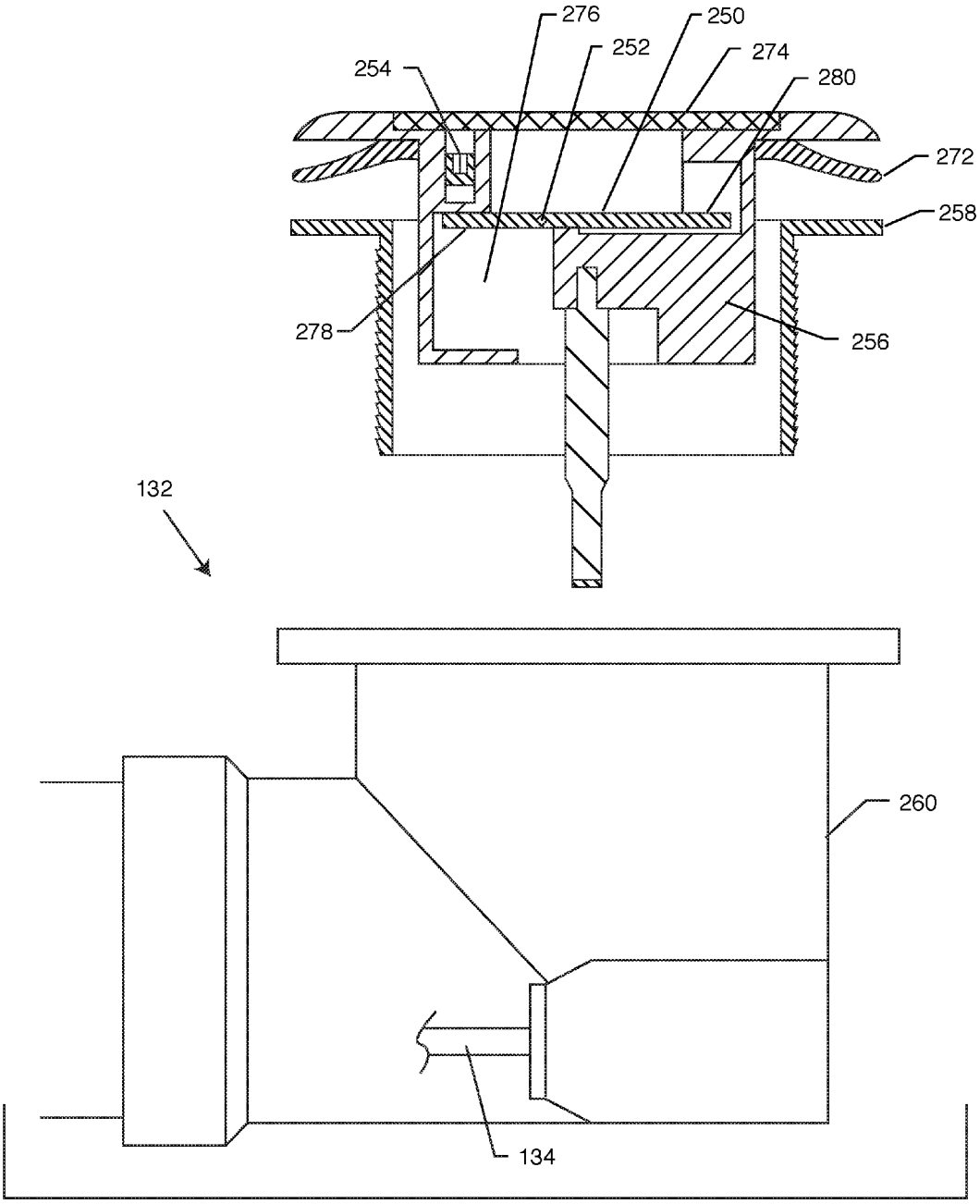
FIG. 16 is a partial sectional view of an exemplary drain plug incorporating an internal overflow valve.
Figure 17:
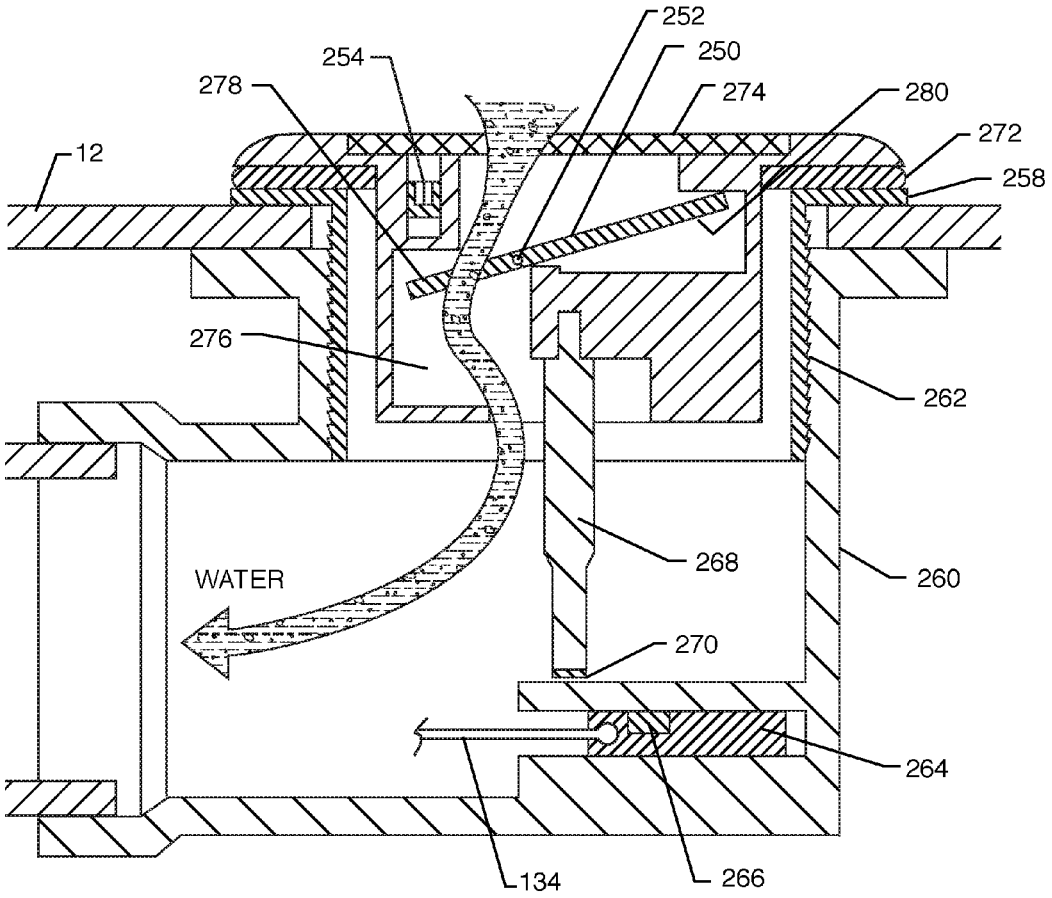
FIG. 17 is a structural view through the structure of FIG. 16 when installed onto a tub.

FIG. 16 is a partial sectional view showing an exemplary embodiment of a bottom drain assembly 132 with an internal overflow valve 250 integrated into a drain plug 256. FIG. 17 is a sectional view of the structure of FIG. 16 showing how the invention works in practice. A drain flange 258 comes from above the tub 12 and the drain housing 260 comes from below the tub 12, and generally speaking, they attach to one another through a screw thread 262 or the like. For simplicity, not shown are various seals that help prevent leaks between the bottom drain assembly 132 and the tub 12.

As the cable 134 is moved forwards and backwards, it moves a slide 264 which includes a magnet 266. The stem 268 may also include a magnet or a ferromagnetic material 270, or vice versa. When the magnets 268 and 270 are aligned above one another, it forces the stem upwards and pops open the drain plug 256 from the flange 258. As is shown a seal 272 creates a water tight seal between the drain plug 256 and the flange 258.

The drain plug 256 may comprise a pressure dependent water passageway 276 extending from a top of the drain plug to a bottom of the drain plug. As is shown in FIG. 17, the drain plug 256 is in the closed position. As the water level in the tub 12 increases, it will create more water pressure onto the drain plug 256. A mesh screen or gate 274 is at the top of the drain plug allowing pressure to build up onto a valve 250.

The pressure dependent water passageway 276 includes the pivotable and at least partially ferromagnetic valve 250 held in a closed position by the adjustably positionable magnet 254. As before, the magnet 254 can be moved up and down to change the force it exerts on the valve 250. When the valve 256 is disposed in the closed position as shown in FIG. 16 it is generally horizontal and the location of the pivot 252 is offset about a center of the valve 250 separating a lighter portion 278 of the valve from a heavier portion 280 of the valve.

The magnet 254 is disposed above the lighter portion 278 of the valve 250. When submerged, the heavier portion 280 of the valve does not block a flow of water through the pressure dependent water passageway 276 and the lighter portion 278 of the valve 250 does actually block the flow of water through the pressure dependent water passageway 276 when in the closed position. As can be seen in FIGS. 16 and 17, water pressure is able to build on both sides of the heavier portion 280 of the valve 250. This means that the water pressure has no effect on the opening and closing of the valve due to the heavier portion 280. The reason for this, is that if the valve is open and all water is drained there through, gravity will automatically close the valve 250 so that it is effectively reset without requiring the user to do anything.

Once the water pressure is too great, it will press upon the lighter portion 278 of the valve 250 and cause it to open. Water is automatically drained and this effectively replaces the overflows found in most tubs 12 today. It is also easy to set the valve 250. The magnet 254 is moved very close to the valve 250. The tub 12 is then filled to the highest level. A user removes the screen 274 and then can reach down into the water and use a screwdriver or other like tool to move the magnet 254 upwards and away from the valve 250. At some point the water pressure overcomes the magnetic attraction and automatically opens the valve 250.

Figure 18:
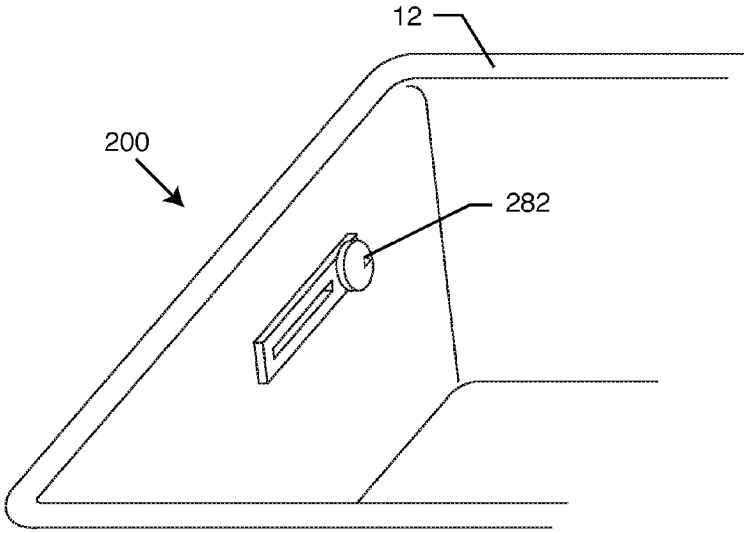
FIG. 18 is a perspective view of a closeable overflow having a cable drain knob.
Figure 19:
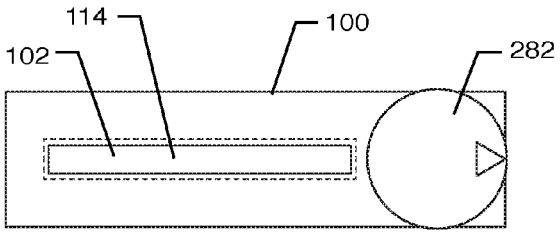
FIG. 19 is a front view of the structure of FIG. 18 showing the overflow open and the knob in a first position.
Figure 20:
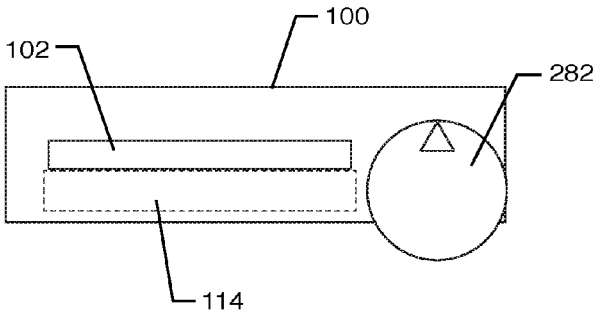
FIG. 20 is a front view of the structure of FIG. 18 showing the overflow closed and the knob in a second position.

FIG. 18 is a perspective view of another exemplary of a closeable overflow 200 now with a drain knob 282. As shown in FIG. 19 the overflow is open, such that water can evacuate into the overflow elbow 14. The drain knob 282 is rotatable as shown here, but could be translatably moved. The drain knob 282 is connected to the cable 134 that would then control the closing and opening of a standard drain housing 260 or the embodiments shown in FIGS. 16 and 17. FIG. 20 shows that the cover 100 has been moved upwards to close the overflow and now the drain knob has been rotated to move the cable 134 thereby opening or closing the drain housing 260.

An exemplary embodiment of the present invention is an electronic control system 284 for a tub 12 or a basin 12. The system includes a key pad 286 having a drain button, a blower button and a pump button. The blower and pump button are optional and control various features of high end tubs 12. A control box 288 is in electrical communication with the key pad 286. A motorized and electronically controlled bottom drain assembly 260 is in electrical communication with the control box 288. When the user presses the drain button, the bottom drain assembly 260 will either open or close. In this embodiment, the overflow 10 is a prior art overflow.

Figure 21:
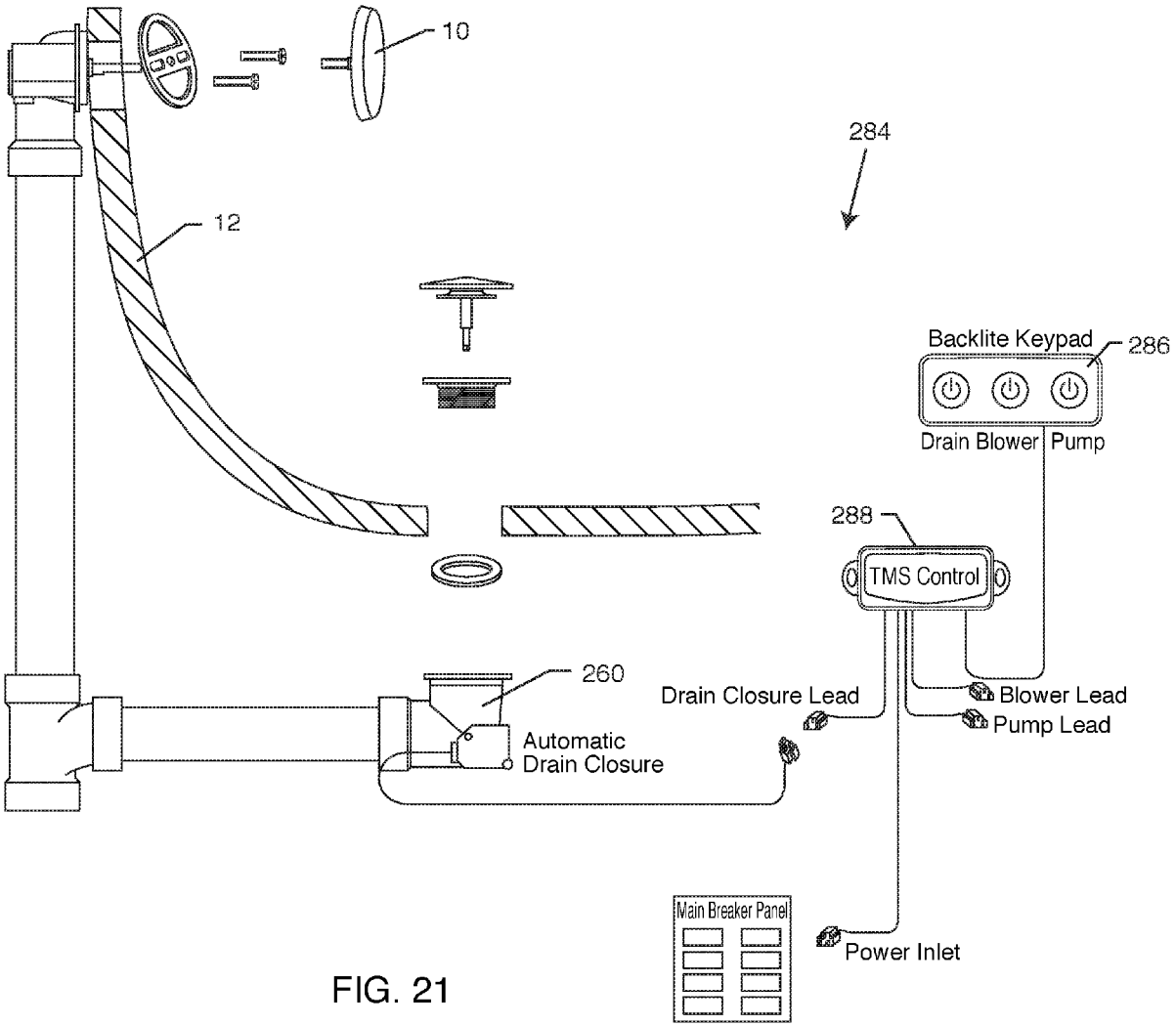
FIG. 21 is a partial sectional and partial schematic view of an exemplary electronic control for a motorized bottom drain with a prior art overflow.
Figure 22:
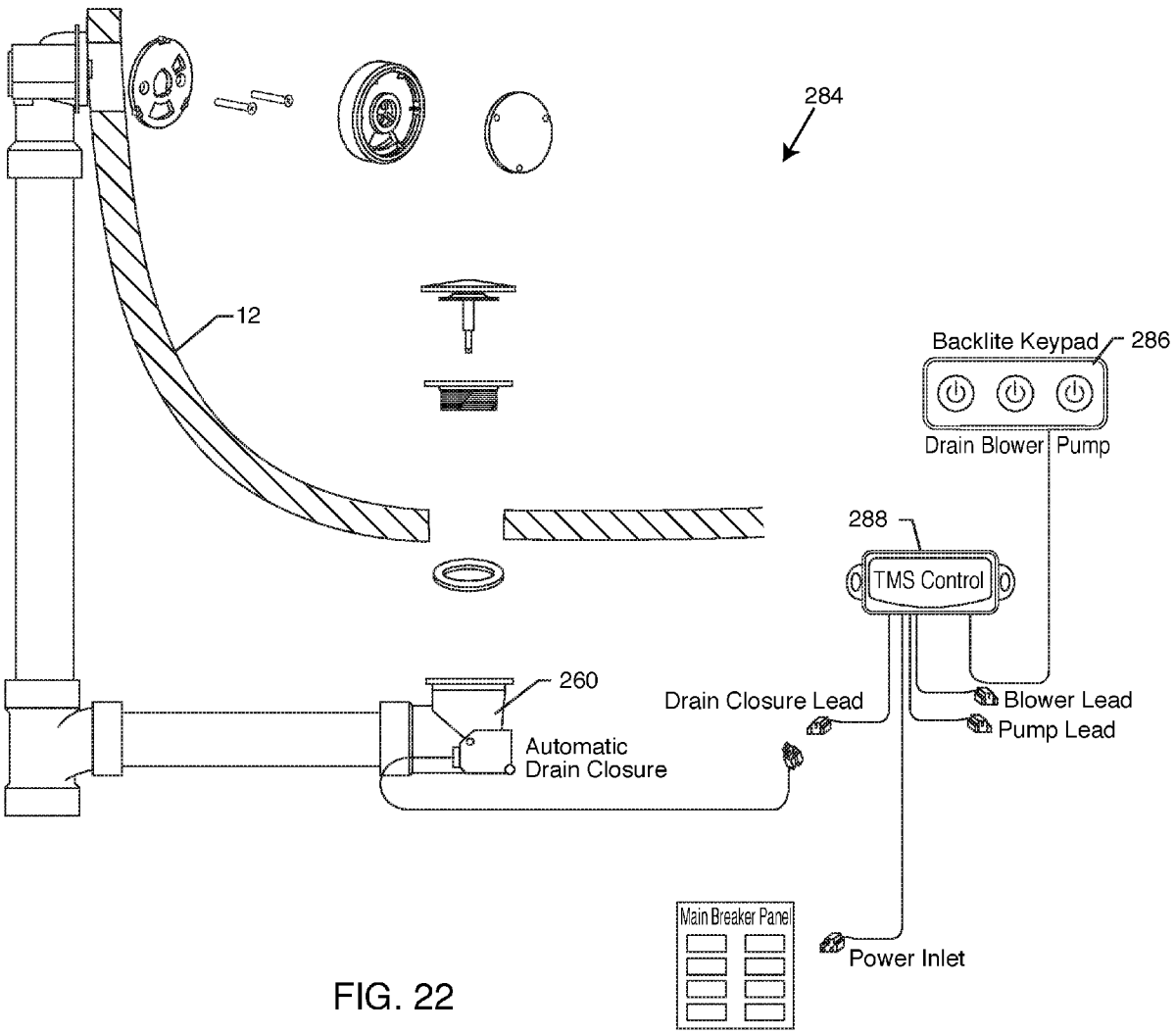
FIG. 22 is a partial sectional and partial schematic view of an exemplary electronic control for a motorized bottom drain now with the applicant's novel overflow disclosed in a previous application incorporated herein.

The embodiment shown in FIG. 22 is similar to FIG. 21, yet now the novel overflow device 10 from the applicant's previous patents has been used herein. This allows a user to fill the tub 12 to a higher level and get a deeper soak as previously taught. It is also understood by those skilled in the art that the novel overflows taught in this application could be used in place of the overflow depicted in FIG. 22. For example, the embodiments shown in FIGS. 3-15 could be used instead of the round overflow currently shown.

Figure 23:
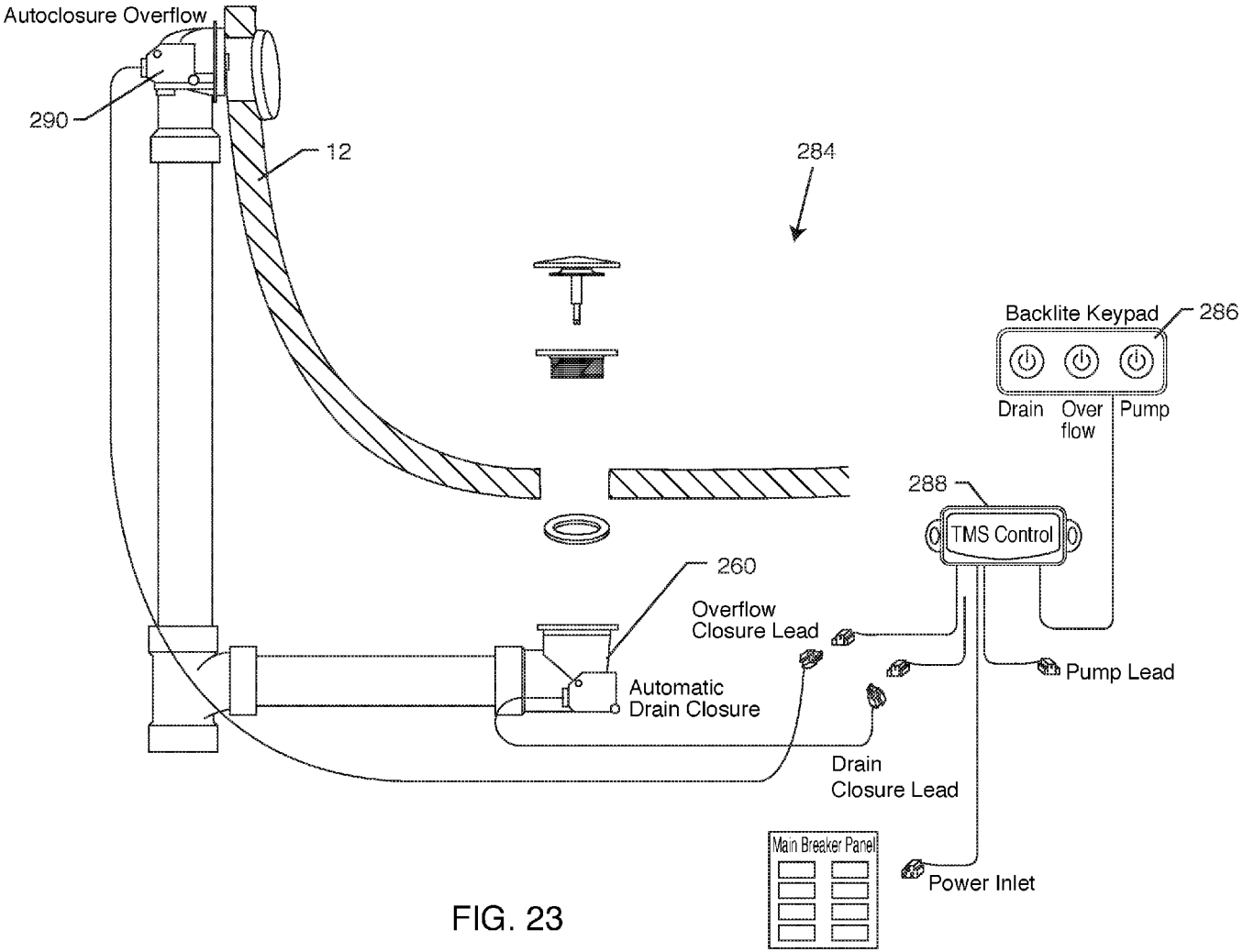
FIG. 23 is a partial sectional and partial schematic view of an exemplary electronic control for a motorized bottom drain and a motorized overflow.

The embodiment shown in FIG. 23 is similar to FIGS. 21 and 22, yet now the overflow device 10 has been replaced with a motorized and electronically controlled overflow valve assembly 290. Accordingly, the keypad 286 has a button for both the bottom drain and also now the overflow.

Figure 24:
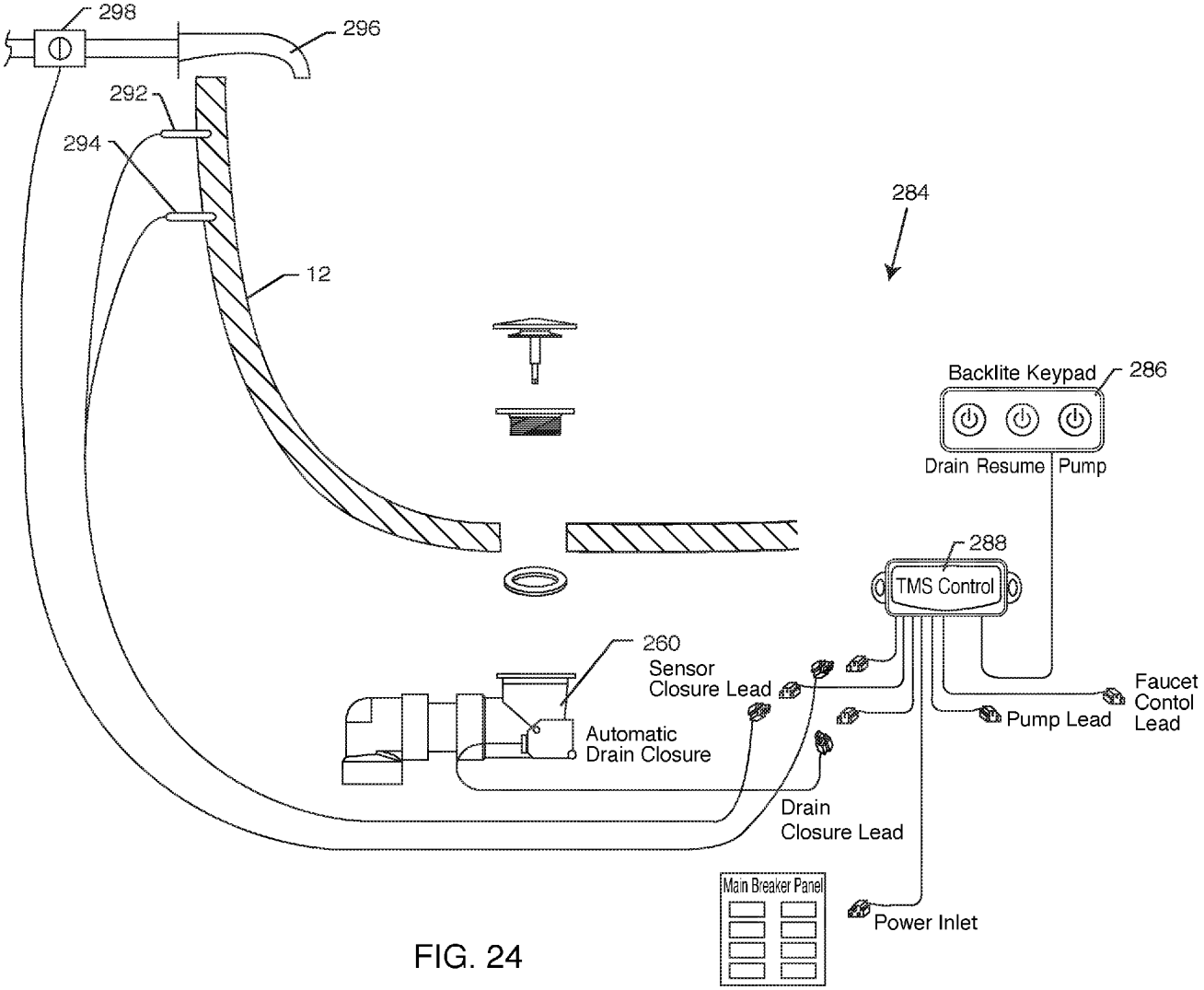
FIG. 24 is a partial sectional and partial schematic view of an exemplary electronic control for a motorized bottom drain now with no overflow and instead having a sensor system to control the bottom drain such that the overflow can be safely eliminated.

In efforts to make the tub 12 as sleek as possible, the overflow can be removed entirely and the bottom drain 260 can function as the overflow as well as the bottom drain. FIG. 24 is similar to the previous embodiments shown in FIGS. 21-22, but now the tub 12 has no physical overflow disposed at the top. A first sensor 292 is configured to be disposed near or at the top of the tub or the basin. The first sensor 292 is in electrical communication with the control box 288. A second sensor 294 is configured to be disposed below the first sensor 292. The second sensor is also in electrical communication with the control box 288. The first and second sensors are able to detect if water is adjacently disposed, meaning that the water level has risen to the height of the sensor.

The drain button on the key pad 286 controls an opening and closing of the bottom drain assembly 260. However, now a motorized and electrically controlled flow valve 298 is located at, within or before a faucet 296 associated with the tub or the basin 12. The flow valve 298 is also in electrical communication with the control box 288.

In use, the control box 288 sends a first signal to the flow valve 298 to stop a flow of water when a water level reaches the second sensor 294. This is useful when the user turns on the faucet 296 and walks away. It is undesired to fill initially all the way up to the first sensor 292 because when a person gets into the tub they displace a large volume of water. Therefore, one must already be in the tub before it can be filled to its highest desired level. The user can then activate the resume fill button once they are in the tub which then causes the control box 288 to open the flow valve 298 to resume the flow of water from the faucet 296.

The control box 288 sends a second signal to the bottom drain assembly 260 to open when the water level reaches the first sensor 292 and can send a third signal to the flow valve 298 to stop a flow of water. Alternatively, the control box can fully drain the tub or drain it back to the water level at the second sensor 294. As can be seen, the applicant's novel control method allows the removal of the overflow drain in total. As a safety precaution, the pressure dependent drain plug from FIGS. 16 and 17 can be used herein in case of an electrical failure.

As is understood by those in the prior art, any of the embodiments taught herein or in the previously incorporated by reference applications can have the teachings of one embodiment applied to another, as the embodiments are not exclusive of each other but rather are inclusive in their teachings. Although several embodiments have been described in detail for purposes of illustration, various modifications may be made to each without departing from the scope and spirit of the invention.

What is claimed is:

1. A closeable overflow for a tub or a basin, comprising:

a bracket attachable to an inside vertical surface of the tub or the basin, the bracket defining a flat front bracket surface opposite a flat back bracket surface, the flat back bracket surface configured to abut the inside vertical surface of the tub or the basin with the flat front bracket surface facing outwardly into the tub or the basin;

at least one fixture aperture disposed through the bracket extending to and between the flat front and back bracket surfaces;

at least one water passageway disposed through the bracket extending to and between the flat front and back bracket surfaces;

a rectangular shaped cover attachable to the bracket and translatably movable by a user along a plane of the flat front bracket surface, the cover defining a flat front cover surface opposite a flat back cover surface;

at least one drain aperture disposed through the cover extending to and between the flat front and back cover surfaces;

wherein the cover moved by the user to an open position has at least a portion of the at least one drain aperture of the cover overlapping at least a portion of the at least one water passageway of the bracket; and wherein the cover moved by the user to a closed position does not have at least a portion of the at least one drain aperture of the cover overlapping at least a portion of the at least one water passageway of the bracket;

wherein the cover includes an edge disposed along a perimeter of the cover, the edge disposed in a direction away from the flat front cover surface extending beyond the flat back cover surface, the edge defining an outside edge surface opposite an inside edge surface;

wherein a channel is disposed on at least a portion of the inside edge surface;

wherein the bracket includes at least one flexure, wherein when the cover is attached to the bracket the at least one flexure is partially disposed within the channel creating a force biasing the cover to remain attached to the bracket.

2. The closeable overflow of claim 1, including a first seal disposed between the flat front bracket surface and the flat back cover surface, wherein the first seal is a gasket or an o-ring.

3. The closeable overflow of claim 2, wherein the at least one fixture aperture comprises a counterbore or a countersink, the counterbore or the countersink fully encasing a head of a fastener where a top of the head of the fastener is at or below the flat front bracket surface, wherein a threaded portion of the fastener extends through the at least one fixture aperture and protrudes past the flat back bracket surface.

4. The closeable overflow of claim 3, including a second seal attached to the flat back bracket surface.

5. The closeable overflow of claim 3, wherein the at least one fixture aperture comprises two apertures disposed on either sides of the at least one water passageway.

6. The closeable overflow of claim 1, wherein the bracket includes a secondary water passageway connecting a top of the bracket to the at least one water passageway.

7. The closeable overflow of claim 1, including a movable bottom drain knob disposed on the flat front cover surface, the movable bottom drain knob attached to a cable, the cable configured to control a closing and opening of a bottom drain, the bottom drain having a drain plug sealable to a drain flange.

8. A closeable overflow for a tub or basin, comprising:

a bracket attachable to an inside vertical surface of the tub or the basin, the bracket defining a flat front bracket surface opposite a flat back bracket surface, the flat back bracket surface configured to abut the inside vertical surface of the tub or the basin with the flat front bracket surface facing outwardly into the tub or the basin;

at least one fixture aperture disposed through the bracket extending to and between the flat front and back bracket surfaces;

at least one water passageway disposed through the bracket extending to and between the flat front and back bracket surfaces;

a rectangular shaped cover attachable to the bracket and translatably movable up and down by a user along a plane of the flat front bracket surface, the cover defining a flat front cover surface opposite a flat back cover surface;

at least one drain aperture disposed through the cover extending to and between the flat front and back cover surfaces;

an edge disposed along a perimeter of the cover, the edge disposed in a direction away from the flat front cover surface extending beyond the flat back cover surface, the edge defining an outside edge surface opposite an inside edge surface;

a channel disposed on at least a portion of the inside edge surface of the cover; wherein the cover moved by the user to an open position has at least a portion of the at least one drain aperture of the cover overlapping at least a portion of the at least one water passageway of the bracket;

wherein the cover moved by the user to a closed position does not have at least a portion of the at least one drain aperture of the cover overlapping at least a portion of the at least one water passageway of the bracket; and wherein the bracket includes at least one flexure or at least one pin biased by a spring, wherein when the cover is attached to the bracket the at least one flexure or the at least one pin is partially disposed within the channel creating a force biasing the cover to remain attached to the bracket.

9. The closeable overflow of claim 8, wherein the at least one fixture aperture comprises a counterbore or a countersink, the counterbore or the countersink fully encasing a head of a fastener where a top of the head of the fastener is at or below the flat front bracket surface, wherein a threaded portion of the fastener extends through the at least one fixture aperture and protrudes past the flat back bracket surface; and wherein the bracket is attachable to an overflow elbow through the use of the fastener when the overflow elbow is disposed on an opposite side of the tub or the basin.

10. The closeable overflow of claim 8, including a first seal disposed between the flat front bracket surface and the flat back cover surface, wherein the first seal is a gasket or an o-ring.

11. The closeable overflow of claim 8, wherein the at least one fixture aperture comprises two apertures disposed on either sides of the at least one water passageway.

12. A closeable overflow for a tub or basin, comprising:

a bracket attachable to an inside vertical surface of the tub or the basin, the bracket defining a flat front bracket surface opposite a flat back bracket surface, the flat back bracket surface configured to abut the inside vertical surface of the tub or the basin with the flat front bracket surface facing outwardly into the tub or the basin;

at least one fixture aperture disposed through the bracket extending to and between the flat front and back bracket surfaces;

at least one water passageway disposed through the bracket extending to and between the flat front and back bracket surfaces;

a rectangular shaped cover attachable to the bracket and translatably movable up and down by a user along a plane of the flat front bracket surface, the cover defining a flat front cover surface opposite a flat back cover surface;

at least one drain aperture disposed through the cover extending to and between the flat front and back cover surfaces;

an edge disposed along a perimeter of the cover, the edge disposed in a direction away from the flat front cover surface extending beyond the flat back cover surface, the edge defining an outside edge surface opposite an inside edge surface;

a channel disposed on at least a portion of the inside edge surface of the cover; wherein the cover moved by the user to an open position has at least a portion of the at least one drain aperture of the cover overlapping at least a portion of the at least one water passageway of the bracket;

wherein the cover moved by the user to a closed position does not have at least a portion of the at least one drain aperture of the cover overlapping at least a portion of the at least one water passageway of the bracket; and wherein the bracket includes at least one flexure or at least one pin biased by a spring, wherein when the cover is attached to the bracket the at least one flexure or the at least one pin is partially disposed within the channel creating a force biasing the cover to remain attached to the bracket;

wherein the bracket includes a secondary water passageway connecting the flat front bracket surface or an edge surface of the bracket to the at least one water passageway, the secondary water passageway including a pivotable and at least partially ferromagnetic valve held in a closed position by an adjustably positionable magnet.

* * * * *